US006951323B1

(12) United States Patent
McNichol

(10) Patent No.: US 6,951,323 B1
(45) Date of Patent: Oct. 4, 2005

(54) GUTTER HANGER

(75) Inventor: John McNichol, Holland, PA (US)

(73) Assignee: Berger Bros Co., Feasterville, PA (US)

( * ) Notice: Subject to any disclaimer, the term of this patent is extended or adjusted under 35 U.S.C. 154(b) by 0 days.

(21) Appl. No.: 10/428,923

(22) Filed: May 5, 2003

(51) Int. Cl.[7] ..... E04D 13/064
(52) U.S. Cl. ..... 248/48.1; 52/11; 52/12
(58) Field of Search ..... 248/48.1, 48.2; 52/12, 11

(56) References Cited

U.S. PATENT DOCUMENTS 1,846,601 A * 2/1932 Kumpf ..... 248/48.1
1,920,520 A * 8/1933 Nord ..... 248/48.2
1,954,001 A * 4/1934 Turer ..... 248/48.1
2,004,861 A * 6/1935 Feltman ..... 248/48.2
2,239,468 A * 4/1941 Rachlin ..... 248/48.1
2,349,467 A * 5/1944 Scott ..... 248/48.2

* cited by examiner

*Primary Examiner*—Leslie A. Braun
*Assistant Examiner*—Tan Le
(74) *Attorney, Agent, or Firm*—James Creighton Wray; Meera P. Narasimhan

(57) ABSTRACT

A new half round gutter hanger provides a stronger product and maintains circles that are interchangeable with existing shanks installed on structures. A double thickness center section has four precise holes located on an engagement surface that is more than two times larger than the prior plate. Extrusions extending from around the through-holes in the circles fit tightly in holes in the double thickness mounting extensions of the plates. A fastener inserted through a single one of the holes holds the circle supported on the plate. Engaging the rolled lip with both end hooks of a U-shaped wire spring extending from the closed slot in the opposite end completes the installation.

12 Claims, 4 Drawing Sheets

GUTTER HANGER

BACKGROUND OF THE INVENTION

Existing combination hangers have plates with lanced tabs riveted to trough-supporting gem circles to connect the mounting plates and circles.

SUMMARY OF THE INVENTION

A new half round gutter hanger has an improved hanger plate and circle. The present invention is an improvement with new features and benefits. It provides a stronger product and maintains circles that are interchangeable with existing shanks installed on structures.

The new plate has a folded metal stamping. A double thickness center section has four precise holes located on an engagement surface that is more than two times larger than the prior plate. The plate can be stamped or cast from ferrous and non-ferrous materials. The holes are located to precisely engage the extrusions on the circle hanger. When engaged, the back edge of the circle gains additional support from the plate. The two members can be joined with a through rivet, nut and bolt, weld, solder or brazing to secure the assembly.

The final assembly has significantly improved resistance to both lateral and rotational loads.

The new circle has a closed slot to retain the spring clip that secures the gutter. The prior circle had an open slot that permitted a clip to disengage and fall away from the gutter. The new circle will retain a loose clip, providing for easy re-engagement by a workman, thereby reducing the cost of replacement materials and reducing the time to obtain and replace the springs. The circle can be produced as a formed extrusion, casting or forging in ferrous and non-ferrous metals.

The circle has through mounting holes at one end. Extrusions extending from around the through-holes in the circles fit tightly in holes in the double thickness mounting extensions of the plates. A fastener inserted through a single one of the holes holds the circle supported on the plate. Engaging the rolled lip with both end hooks of a U-shaped wire spring extending from the closed slot in the opposite end completes the installation.

A chalked line is angled for a proper drain and snapped against a facia under a soffit. The plates are mounted along the sloping mark. Circles are mounted on the plates by fitting extrusions from the circles into holes in the double thickness plate mounting projections. Fasteners are secured in the holes. The gutter trough is placed in the aligned circles, and the spring clips are hooked onto the rolled outer edge of the gutter.

The concept is utilized on other shapes. Plates with holes that engage protrusions enable better attachment of hangers that can be semi-circles, circles, rectangles, trapezoids or otherwise configured to match and underlie custom trough shapes for conducting or conveying rainwater, fluids or solids.

The invention provides an eaves trough gutter mounting plate, having a central folded double wall mounting protrusion with through-holes extending through the protrusion and having end portions extending outward from the central mounting protrusion, forming mounting flanges on either side of the protrusion, the mounting flanges having mounting openings for receiving fasteners extending through the openings into a facia board under a soffit of a building.

The invention also provides a shaped gutter support having a first inner end with a hook for engaging an inner edge of a gutter, and extrusions extending laterally from the hanger for at least partially fitting within through-holes in the mounting protrusion of the hanger mounting plate.

Preferably the shaped gutter support has through openings and the extrusions extend laterally from the shaped gutter support and axially from edges of the through openings in the shaped gutter support near the hook for fitting within the through-holes in the hanger-mounting protrusion.

A preferred gutter support has a closed slot at a second outer end of the hanger remote from the hook for receiving a spring with a spring hook for engaging an outer lip of the trough gutter.

When roof straps are used to mount the gutters, the extrusions fit within a channel of a roof-mounting strap.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
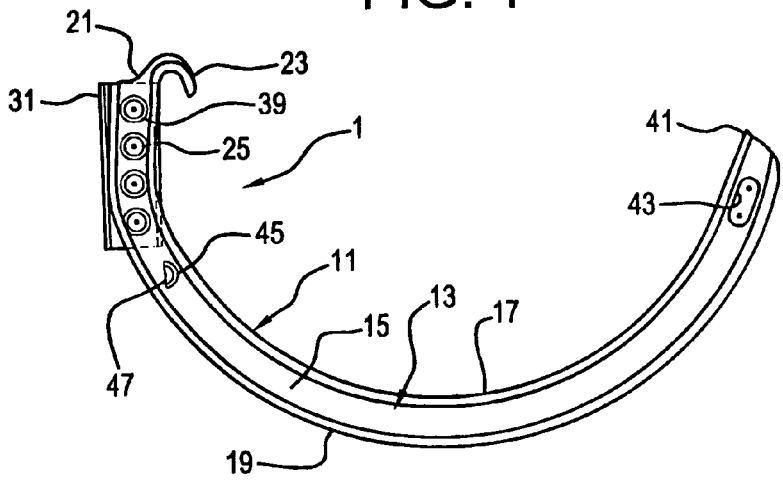
FIG. 1 is a side elevation of the preferred embodiment of the invention showing a hanger and a mounting plate.
Figure 2:
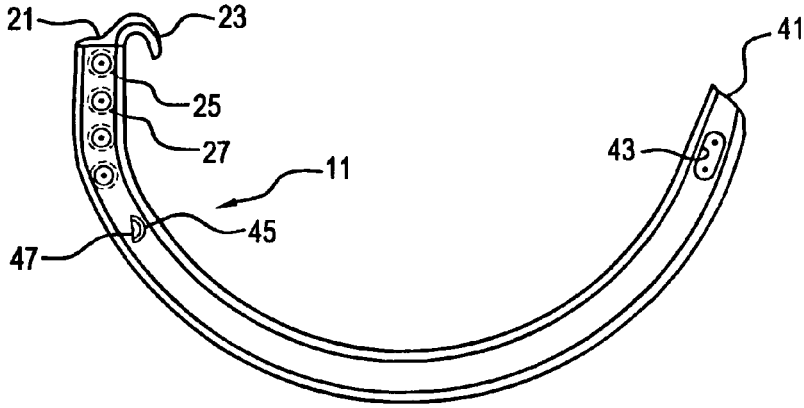
FIG. 2 is a side elevation of a hanger.
Figure 3:
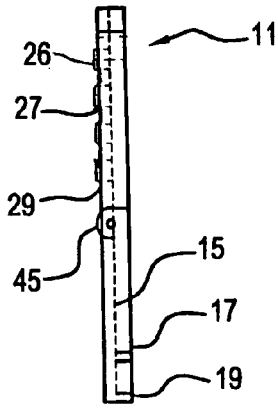
FIG. 3 is an end view of the hanger.

Referring to FIGS. 1–3 of the drawings, a gutter mounting assembly is generally referred to by the numeral 1. A shaped hanger 11 has any shape which is suited to and fittable about a shaped trough. In the case shown in the drawings, the shaped hanger has a semicircular shape. The preferred shaped hanger is formed as a channel 13 with a flat center 15 and inner and outer flanges 17 and 19. One end 21 of the hanger has a hook 23 which engages an inner edge of a gutter trough. Openings 25 are formed through the flat surface 15 between the flanges 17 and 19, and material from the holes is extruded into extrusions 27, which are cylindrical projections or bosses on flat outer walls 29. Extrusions 26 fit within through-holes 39 in a central mounting projection 37 of mounting plate 31.

The hanger has a free outer end 41 spaced opposite from the inner end 21. A closed slot 43 near the free end retains a gutter spring clip. If the spring clip becomes dislodged from the gutter, it remains attached in the closed slot 43.

A detent 45 is pressed outward from the flat surface 15 to engage an edge of a strap when a different type of mounting plate or strap is used. In a preferred form, the detente has a flat surface 47 for positively engaging the strap.

Figure 4:
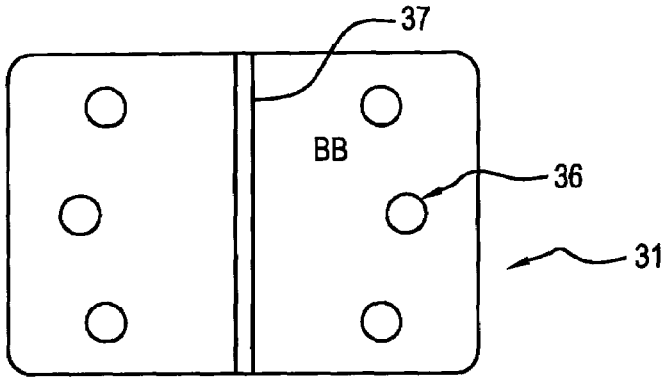
FIG. 4 is a side elevation of the mounting plate.
Figure 5:
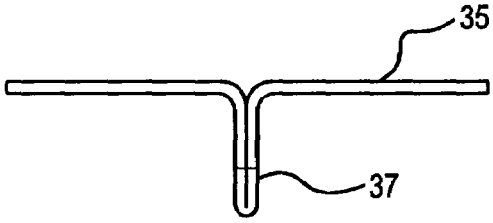
FIG. 5 is a top view of the mounting plate.
Figure 6:
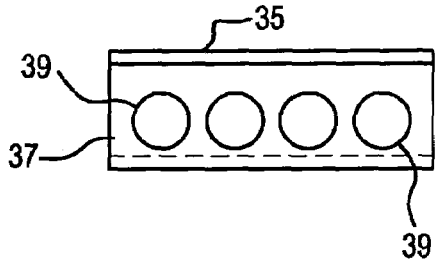
FIG. 6 is a side elevation of the mounting plate showing the mounting projection.

As shown in FIGS. 4–6, the preferred mounting plate 31 has flat mounting faces 35 which are placed against a facia under a soffit, for example. Mounting holes 36 extend through the flat mounting sections 35 for receiving nails or screws attached to the facia.

Figure 7:
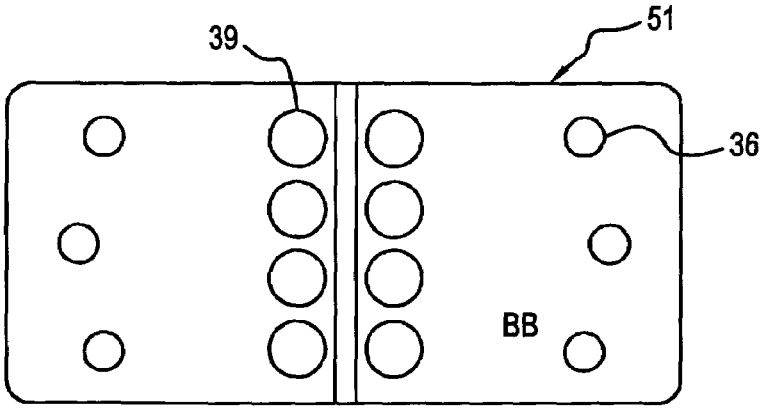
FIG. 7 is a developmental front view of the mounting plate as it is stamped with the mounting holes and through openings in the center section, which will be folded into the double walled mounting projection.
Figure 8:
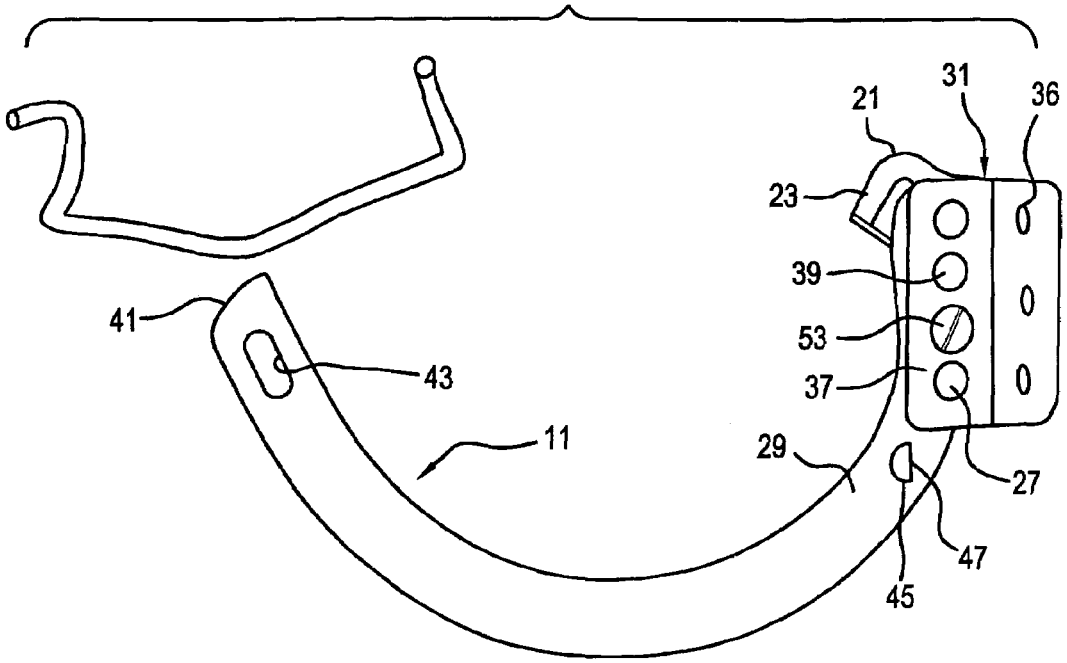
FIG. 8 is a perspective view of the channel formed mounting hanger mounted on the mounting plate.

A raised central mounting projection 37 is formed by folding the flat blank 51, as shown in FIG. 7, after two rows of precise holes 39 have been formed. The holes 39 engage the precision extrusions 27 on the circle or bracket, as shown in FIG. 3. Forming the mounting protrusion as a double layer thickness strengthens the mounting plate. Precisely fitting the outer cylindrical surfaces 27 of the extrusions 26 in the mounting holes 39 strengthens and rigidities the combined structure. As shown in FIG. 8, a fastener 53 is placed through one pair of the aligned holes 25 in the circle and holes 39 in the mounting projection 37.

Figure 9:
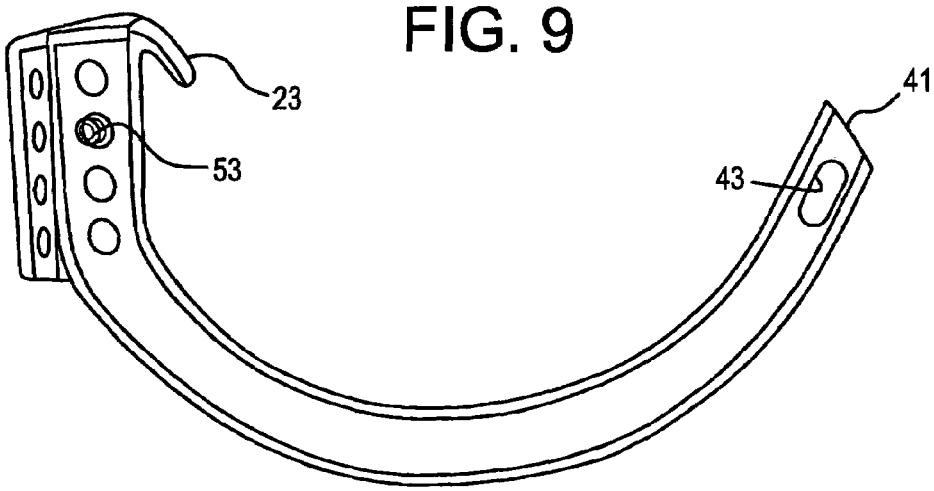
FIG. 9 is a perspective view of the opposite side of the hanger and mounting plate.
Figure 10:
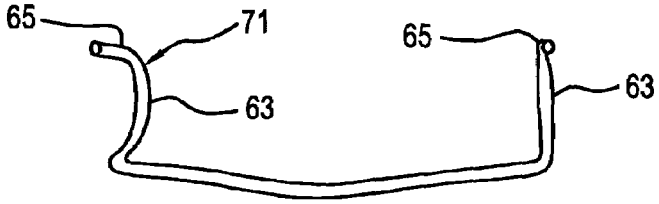
FIG. 10 is a perspective view of a U-shaped spring clip with hooks for mounting on a rolled edge of a gutter trough.

FIGS. 8 and 9 show assembled views, and FIG. 10 shows a U-shaped spring clip 71 having a central portion 73, which extends through the closed slot 43 in the end 41 of the circle 11. Hooks 65 on ends 63 of the spring clip engage a rolled outer edge of a gutter.

Figure 11:
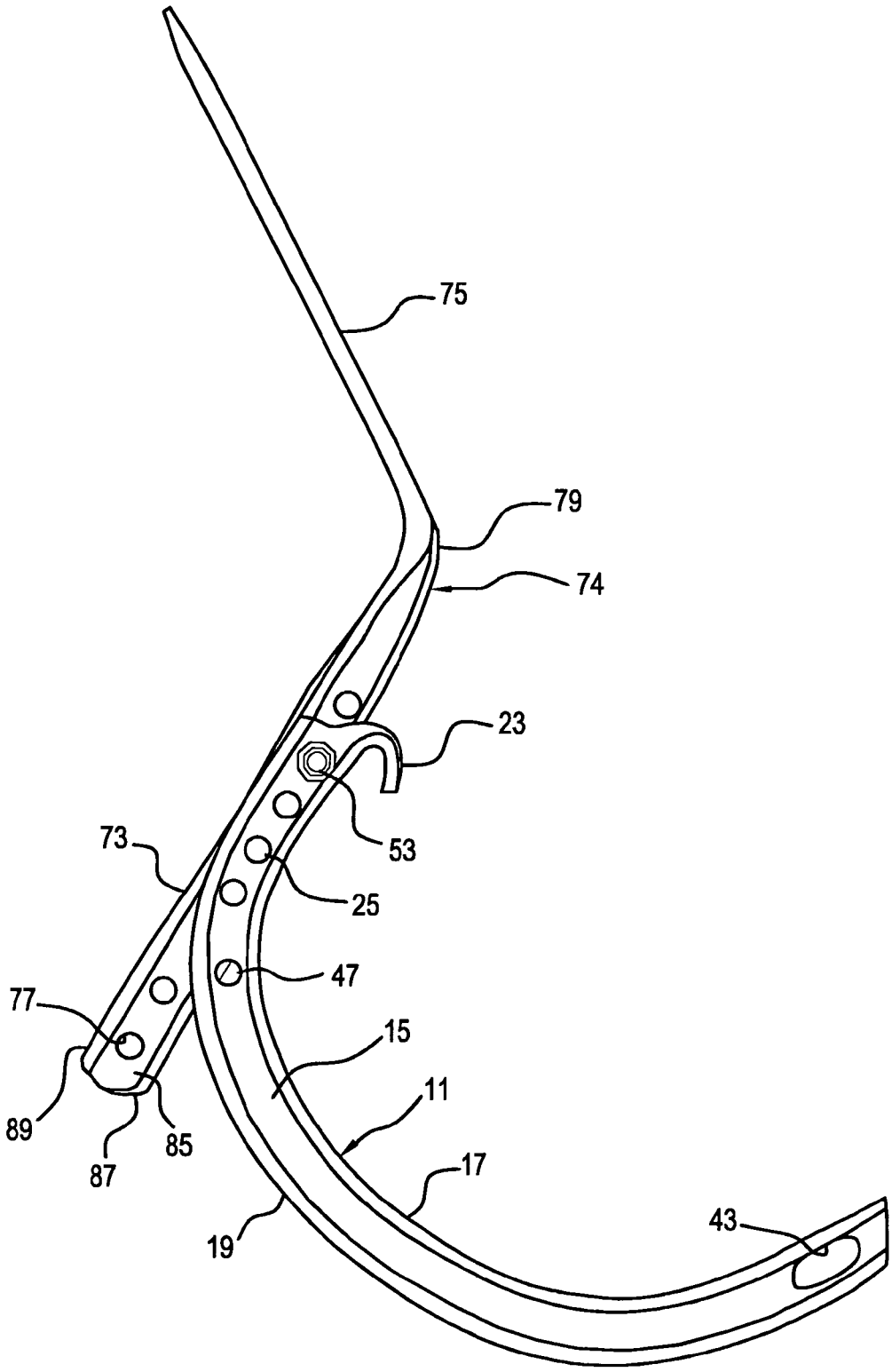
FIG. 11 is a perspective view of a hanger attached to an under roof strap.

FIG. 11 shows an alternate embodiment of the invention in which the circle 11 is mounted on a downward extension 73 of an under-roof-mounted strap 74. An upper sloping portion 75 of the strap has openings for securing to a roof sheathing by nails or screws. At least one of the openings 77 in the lower portion 73 of the strap is aligned with an opening 25 in the circle 11. A strap such as 74 is usually formed from a channel member, which is turned at its central portion 79. The channel has a flat central portion 85 and flanges 87 and 89, and the extrusions 27 from the openings 25 fit within the channel and engage one or both of the flanges 87 and 89 to further rigidify the structure.

While the invention has been described with reference to specific embodiments, modifications and variations of the invention may be constructed without departing from the scope of the invention, which is defined in the following claims.

I claim:

1. An eaves trough gutter mounting plate apparatus, comprising a central folded double wall mounting protrusion with through-holes extending through the protrusion and having end portions extending outward from the protrusion forming mounting flanges on either side of the protrusion, the mounting flanges having mounting openings for receiving fasteners extending through the openings into a facia board under a soffit of a building, further comprising a shaped gutter support having a first inner end with a hook for engaging an inner edge of a gutter, and extensions extending laterally from the support for at least partially fitting within the through-holes in the protrusion of the gutter mounting plate.

2. The apparatus of claim 1, wherein the shaped gutter support has through openings, and wherein the extensions extend laterally from the shaped gutter support and axially from edges of the through openings in the shaped gutter support near the hook for fitting within the through-holes in the protrusion.

3. The apparatus of claim 2, further comprising a closed slot at a second outer end of the hanger remote from the hook for receiving a spring with a spring hook in the closed slot for engaging an outer lip of the trough gutter.

4. The apparatus of claim 2, wherein the extensions fit within a channel of a roof-mounting strap.

5. An eaves trough gutter mounting apparatus, comprising a shaped gutter support having a first inner end with a hook for engaging an inner edge of a gutter, and extensions extending laterally from the support for at least partially fitting within through-holes in a mounting protrusion of a hanger mounting plate, further comprising an eaves trough gutter mounting plate having a central folded double wall mounting protrusion with through-holes extending through the protrusion and having end portions extending outward from the central mounting protrusion forming mounting flanges on either side of the protrusion, the mounting flanges having mounting openings for receiving fasteners extending through the openings into a facia board under a soffit of a building.

6. The apparatus of claim 5, wherein the shaped gutter support has through openings, and wherein the extensions extend laterally from the shaped gutter support and axially from edges of the through openings in the shaped gutter support near the hook for fitting within the through-holes in the hanger-mounting plate.

7. The apparatus of claim 5, further comprising a closed slot at a second outer end of the hanger remote from the hook for receiving a spring with a spring hook in the closed slot for engaging an outer lip of the trough gutter.

8. The apparatus of claim 5, wherein the extensions fit within a channel of a roof-mounting strap.

9. An eaves trough gutter mounting method, comprising the steps of: providing an eaves trough gutter mounting plate, providing a central folded double wall mounting protrusion, providing through-holes extending through the protrusion, providing end portions extending outward from the central mounting protrusion forming mounting flanges on either side of the protrusion, and providing mounting openings in the mounting flanges receiving fasteners extending through the openings into a facia board under a soffit of a building, further comprising providing a shaped gutter support, providing a first inner end of the support with a hook for engaging an inner edge of a gutter, providing extensions extending laterally from a wall of the support, and at least partially fitting the extensions within the through-holes in the mounting protrusion of the hanger mounting plate.

10. The method of claim 9, further comprising providing the shaped gutter support with through openings, and extending the extensions laterally from the shaped gutter support and axially from edges of the through openings in the shaped gutter support near the hook, and fitting within the through-holes in the hanger-mounting truss.

11. The method of claim 10, further comprising providing a closed slot at second outer end of the hanger remote from the hook for receiving a spring providing a spring hook in the closed slot for engaging an outer lip of the trough gutter.

12. The method of claim 10, further comprising fitting the extensions within a channel of a roof-mounting strap.

* * * * *